United States Patent [19]

Kolb et al.

[11] 4,248,963

[45] Feb. 3, 1981

[54] METHOD OF PREVENTING THE FORMATION OF CONTACT SPOTS ON PHOTOGRAPHIC MATERIALS

[75] Inventors: Günter Kolb; Bernhard Morcher, both of Leverkusen, Fed. Rep. of Germany

[73] Assignee: AFGA-Gevaert, A.G., Leverkusen, Fed. Rep. of Germany

[21] Appl. No.: 908,570

[22] Filed: May 22, 1978

Related U.S. Application Data

[63] Continuation of Ser. No. 757,829, Jan. 10, 1977, abandoned.

[30] Foreign Application Priority Data

Jan. 15, 1976 [DE] Fed. Rep. of Germany ..... 2601377

[51] Int. Cl.[3] ..... G03C 1/78; G03C 3/00

[52] U.S. Cl. ..... 430/501; 430/523; 430/539; 430/961

[58] Field of Search ..... 96/87, 67; 430/501, 430/523, 539

[56] References Cited

U.S. PATENT DOCUMENTS

| | | | |
|---|---|---|---|
| 2,362,580 | 11/1944 | Nadeau et al. | 96/87 R |
| 3,079,257 | 2/1963 | Morcher et al. | 96/67 |

OTHER PUBLICATIONS

Bovey et al., Emulsion Polymerization, pp. 161–163, Interscience, N.Y. 1955.

Chemical Abstracts vol. 69, col. 78147x.

*Primary Examiner*—John D. Welsh

*Attorney, Agent, or Firm*—Connolly & Hutz

[57] ABSTRACT

In a process for preventing the contact spots formed by contact of the back coating of photographic material with the emulsion side an aqueous polymer dispersion obtained by polymerization of halogen-free compounds and polyvinyl alcohol or partially acetylated polyvinyl alcohol in the presence of an anionic emulsifier are added to the casting composition applied as outermost back coating and/or as uppermost layer.

1 Claim, No Drawings

METHOD OF PREVENTING THE FORMATION OF CONTACT SPOTS ON PHOTOGRAPHIC MATERIALS

This application is a continuation of co-pending application Ser. No. 757,829 filed Jan. 10, 1977 for Method Of Preventing The Formation Of Contact Spots On Photographic Materials by Kolb et al, now abandoned.

This invention relates to a method of preventing the formation of so-called contact spots which occur when the back of a photographic material comes into contact with the emulsion side of the material.

It is already known to add various materials in a more or less finely divided form to photographic layers, particularly to the protective layer or to the back coating, for the purpose of obtaining certain photographic effects, for example in order to produce a matt effect, to prevent the so-called Newtonian effect, to improve the quality of the film surface as a writing surface or for retouching work. Substances added for such purposes include, for example, titanium dioxide; barium sulphate; silicates; oxalates; silicon dioxide; starch; urea formaldehyde resins; polystyrene resins; polyvinyl resins containing chlorine or fluorine and higher waxes. If such additives are to be usable, they must be colourless, completely inert towards the light-sensitive emulsion, dimensionally stable in water and neutral or slightly acid in pH and they must form stable aqueous dispersions which do not settle out and can be infinitely diluted with the casting solutions.

The prevention of so-called contact spots presents a special problem.

Contact spots are the marks which are generally produced when the back of a photographic material comes into close contact with the emulsion side of the material, as, for example, when photographic materials are rolled up or stacked. These spots cannot be prevented with the aid of known additives without undesirable side effects.

The formation of contact spots may be due to various causes and can therefore also produce various photographic effects. Thus, for example, substances may diffuse from the back coating of the photographic material into the emulsion layer where they may desensitize or fog the photographic emulsion. They are also liable to impair the stability of the latent image. The formation of contact spots is generally promoted by high moisture contents. One disadvantage of the known additives is that the inorganic materials rapidly settle out due to their high specific gravity and cannot be distributed homogeneously. Moreover, these materials are highly reflective so that, in place of the deep black areas one obtains only more or less pronounced grey tones, depending on the quantity of additive used. The average particle diameter of the inorganic substances is between 2 and 5 $\mu$ so that the possibility of a matt effect cannot be excluded even when only small quantities are added. Starch and other carbohydrates and their derivatives are hydrophilic and change their diameter due to swelling in water. Polymers which contain chlorine are thermally unstable while vinyl compounds which contain fluorine cannot be converted by direct polymerisation into aqueous dispersions of the kind required for the given purpose. The same applies to urea formaldehyde resins. Lastly, polyester resins and higher waxes have too low a softening point so that, when mechanically dried at elevated temperatures, they tend to melt and become sticky.

German Pat. No. 1,058,835, corresponding to U.S. Pat. No. 3,079,257, describes matting agents consisting of aqueous suspensions of polymers obtained by the polymerisation of halogen-free vinyl compounds in the presence of water and protective colloids. These polymers can be homogeneously distributed in the casting solutions and do not settle out. They do not impair either the blacks or the whites of the photographic image and show no tendency to adsorb sensitizers or stabilizers. In addition, they are thermally stable and photographically inert. However, they are unsuitable for preventing the formation of contact spots since they produce a high degree of matting even at low doses.

It is an object of the present invention to provide additives for photographic-materials which prevent the formation of contact spots without affecting the photographic properties of the material.

The invention thus relates to a process for preventing the contact spots formed by contact of the back coating of photographic materials with the emulsion side, in which polymer dispersions obtained by the polymerisation of halogen-free vinyl compounds in the presence of water and from 10 to 30% by weight of polyvinyl alcohol or up to 20% by weight of partially acetylated polyvinyl alcohol and from 0.05 to 0.25% by weight of an anionic emulsifier, based on the quantity of monomer used, are added to the casting composition applied as outermost back coating and/or as uppermost layer, the quantity added corresponding to from 2 to 20% by weight of polymer, based on the binder content of the layer.

Suitable halogen-free vinyl compounds are those which are capable of radical polymerisation, which give rise to polymers which are insoluble and incapable of swelling in water and which have a softening point above 80° C. Suitable compounds include acrylonitrile, methyl methacrylate, vinyl acetate and copolymers of such compounds with each other or with other vinyl compounds capable of radical polymerisation but exclude vinyl compounds which contain halogen atoms. Polymers which contain, for example, vinyl chloride or dichloroethane are thermally unstable and therefore do not satisfy the stringent demands of photographic technology. The vinyl compounds which are preferably used are acrylonitrile, methyl methacrylate and mixtures thereof.

The following compounds are examples of anionic emulsifiers suitable for the process according to the invention: Alkali metal or ammonium salts of long chain monocarboxylic acids such as fatty acids or resinic acids, in particular those having from 10 to 20 carbon atoms; semiesters of saturated or unsaturated dicarboxylic acids with long chain monohydric alcohols; water-soluble salts of long chain alkyl sulphuric acid esters; long chain alkylsulphonic acids; alkylarylsulphonic acids or their water-soluble salts; salts of sulphonated oils or salts of fatty acid condensation products with hydroxy- or aminoalkylcarboxylic or sulphonic acids or salts of sulphonated ethylene oxide adducts. Particularly suitable for the process according to the invention are long chain alkylsulphonic acids having from 10 to 20 carbon atoms and water-soluble salts thereof.

Polymerisation of the above mentioned vinyl compounds in the presence of water and from 10 to 30% by weight of polyvinyl alcohol and from 0.05 to 0.25% by weight of an anionic emulsifier, based on the quantity of monomers used, can be carried out with radical forming substances in the usual manner.

Examples of such substances include ammonium persulphate and alkali metal persulphates, organic peroxides, azodiisobutyric acid dinitrile and the known redox systems. For the process according to the invention it is preferred to use the redox combination of potassium or ammonium persulphate and an alkali metal or ammonium bisulphite, sulphite or pyrosulphite. It has surprisingly been found that the anionic emulsifiers added do not impair the black areas of the developed images or their gradation and moreover they are photographically absolutely inert.

Dispersions prepared by the process indicated above are preferably added to aqueous solutions of layer-forming colloids which are used for casting a light-sensitive or photographic auxiliary layer, in particular the protective layer and/or back coating. The quantity of polymer dispersions to be added depends on the effect required for preventing the formation of contact spots. It should preferably amount to from 1 to 10 g of polymer for 50 g of protective colloid. Gelatine may be used alone as the layer forming colloid or it may be partly or completely replaced by other proteins or substitutes, for example by watersoluble high polymer compounds, in particular polvinyl alcohol, polyacrylic acid sodium and other copolymers which contain carboxyl groups, polyvinyl pyrrolidone, polyacrylamide and high molecular weight naturally occurring substances such as dextrans, dextrins, starch ether, alginic acid or alginic acid derivatives.

The light-sensitive emulsion layers contained in the photographic materials used in the process according to the invention may be layers based, for example, on non-sensitized emulsions, orthochromatic, panchromatic or infra-red emulsions, X-ray emulsions or other spectrally sensitized emulsions or they may be the kind of light-sensitive emulsions used for various black-and-white and colour photographic processes, in particular layer combinations used for carrying out colour photographic processes, e.g. those containing emulsion layers treated with solutions which contain color couplers.

When using the process according to the invention, addition of the polymer dispersions provides complete protection against the formation of contact spots without any of the disadvantageous effects of the known additives. In particular, the photographic images undergo only very slight matting if any, and any unwanted gloss on the photographic layer can be broken down to a greater or less extent and levelled off, according to the quantity of additive used. In this way, any uneveness on embossed surfaces can be equalised so that it is possible, for example, to obtain images with a high quality satin finish.

EXAMPLE 1

199.0 g of polyvinyl alcohol, 1.0 g of sodium paraffin sulphonate and 0.2 g of crystallised iron sulphate were dissolved in 7800 g of water and 2000 g of the resulting solution were introduced into a stirrer vessel. The vessel was freed from air by flushing with nitrogen and stirring at the same time, and 5 g of sodium pyrosulphite were added. The solution was then warmed up to 40° C., 5 g of potassium persulphate were added and at the same time a mixture of 950 g of acrylonitrile and 50 g of methyl methacrylate, a solution of 5 g of sodium pyrosulphite in 3000 g of the above mentioned solution and a solution of 10 g of potassium persulphate in 3000 g of the above mentioned solution were continuously pumped in over a period of 2 hours. The reaction mixture was then stirred for a further 2 hours at 45° C. and after cooling to room temperature the polymer dispersion was discharged. It had a solids content of 13.5 g per 100 g of dispersion.

EXAMPLE 2

The procedure was the same as in Example 1 except that 1.5 g of sodium lauryl sulphate were used as emulsifier. A stable polymer dispersion having a concentration of 13.5% was obtained.

EXAMPLE 3

250 g of polyvinyl alcohol, 2.0 g of sodium paraffin sulphonate and 0.2 g of crystallised iron sulphate were dissolved in 7750 g of water. 2000 g of this solution were introduced into a stirrer vessel which had been freed from air and the solution was heated to 40° C. with stirring. At the same time, 1000 g of acrylonitrile, a solution of 20 g of potassium persulphate in 3000 g of the above mentioned solution and a solution of 10 g of sodium pyrosulphite in 3000 g of the above mentioned solution were pumped in continuously over a period of 2½ hours. The reaction mixture was then stirred for a further 2 hours at 45° C. and a 13.5% polyacrylonitrile dispersion was obtained.

EXAMPLE 4

Solution A was applied to one side (reverse side) of a film substrate of acetyl cellulose which had been covered with an adhesive layer on both sides. Solution A had the following composition:

| | |
|---|---|
| 10% Gelatine solution | 1 l |
| 10% Pan yellow | 35 ml |
| 8% Acid green solution | 15 ml |
| 8% Acid fuchsine solution | 30 ml |
| 5% Chrome acetate solution | 25 ml |
| 7.5% Saponin solution | 25 ml. |

Pan yellow (U.S. Pat. No. 2,036,546, page 2, lefthand column, line 50), Acid green (C.I. No. 660) and Acid fuchsine solution (C.I. No. 692) were trade products of Riedel de Haen.

The conditions of the casting machine were adjusted to produce a layer having a thickness of 3 μ.

Layer A was covered with a Solution B having the following composition:

| | |
|---|---|
| 5% Gelatine solution | 1 l |
| 5% Chrome acetate | 30 ml |
| 7.5% Saponin | 60 ml, |

The casting conditions were adjusted to produce layer B 1 μ in thickness.

Solution C was applied to the other side of the film substrate (emulsion side). It had the following composition:

1 kg of a silver halide emulsion (70 g of Ag/kg of emulsion) in which the silver halide consist of 94 mol percent of silver bromide and 6 mol percent of silver iodide and which has a gelatine content of 80 g/kg of emulsion, 30 ml of a 1% solution of 1,3,3a-tetraza-4-hydroxyl-6-methylindene in methanol, 30 ml of a 1% methanolic solution of a sensitizer for the green spectral region having the following formula:

FORMULA 25 ml of a 1% methanolic solution of a sensitizer for the red spectral region having the following formula:

FORMULA 20 ml of a 5% aqueous solution of chrome acetate and 25 ml of a 7.5% aqueous solution of saponin.

The solution was applied to produce a layer containing 7 g of $Ag/m^2$.

This layer C was covered with solution B to form on it a layer having a thickness of 1 $\mu$.

EXAMPLE 5

This material differed from the material in Example 4 by having a solution B of different composition. 30 ml of the dispersion from Example 1 were added to solution B. The resulting solution D was applied to layer A and to layer C from Example 4 to form on them a layer having a thickness of 1 $\mu$.

The materials from Examples 4 and 5 were rolled up and stored in this condition for 7 days at a relative humidity of 80% and a temperature of 35° C.

After storage, a continuously graded grey wedge was exposed in a sensitometer and then developed in a commercial hydroquinone/phenidone fine grain developer for 10 minutes at 20° C., rinsed in water for 2 minutes, fixed in a 10% aqueous sodium thisulphate solution, rinsed again in water for 10 minutes and dried.

The dried samples were inspected on an illuminating table. The sample of material from Example 4 showed bright spots and patches. The material from Example 5 was completely free from spots and showed grey tones of homogeneous density.

EXAMPLE 6

50 ml of the dispersion from Example 3 was used instead of the dispersion from Example 1, as described in Example 5. The surface of the photographic material was similar to that obtained in Example 5 in being free from spots and it had a broken gloss without undesirable reflections.

EXAMPLE 7 (Comparison example)

The procedure was the same as described in Example 1 except that polymerisation was carried out in the absence of the sodium parasulphonate described there.

The dispersion obtained was added to samples of solution B from Example 4 in quantities of 10, 20 and 30 ml respectively.

The three solutions were then applied to layers A and C of a material obtained as in Example 4 to form on them layers having a thickness of 1 $\mu$.

After drying, the samples of photographic material obtained were matt on both sides, even the smallest quantity of dispersion (10 ml) producing an undesirably high matt effect.

We claim:

1. In a process for producing rolled or stacked photographic materials having a silver halide emulsion on a support, the steps of providing materials for the rolled or stacked material, comprising providing a layer cast as a back coating on the opposite side of a support from said supported silver halide emulsion including casting, as the outermost layer on a back coating on the surface of the support for the silver emulsion, a composition consisting essentially of gelatin and 2 to 20% by weight of the gelatin of a polymer dispersion, said polymer dispersion being obtained by polymerizing a halogen-free vinyl monomer compound consisting of acrylonitrile, methylmethacrylate or mixtures thereof in the presence of a mixture comprising water and from 10 to 30% of polyvinyl alcohol or up to 20% of partially acetylated polyvinyl alcohol by weight of the monomer, with an anionic emulsifier selected from the group consisting of long chain alkyl sulphonic acids having from 10 to 20 carbon atoms and their water soluble salts, said back coating being contactible with said emulsion in producing the rolled or stacked photographic materials, whereby said process enhances the suitability of the composition for minimizing contact spots at points of contact between the cast back coating and said emulsion.

* * * * *